US007334741B2

(12) United States Patent
Benson et al.

(10) Patent No.: US 7,334,741 B2
(45) Date of Patent: Feb. 26, 2008

(54) FUEL INJECTOR WITH INJECTION RATE CONTROL

(75) Inventors: Donald J. Benson, Columbus, IN (US); David M. Rix, Columbus, OH (US); Lester L. Peters, Columbus, IN (US); Shankar C. Venkataraman, Columbus, IN (US); C. Edward Morris, Jr., Columbus, IN (US)

(73) Assignee: Cummins Inc., Columbus, IN (US)

( * ) Notice: Subject to any disclaimer, the term of this patent is extended or adjusted under 35 U.S.C. 154(b) by 248 days.

(21) Appl. No.: 11/044,724

(22) Filed: Jan. 28, 2005

(65) Prior Publication Data

US 2008/0006712 A1 Jan. 10, 2008

(51) Int. Cl.
*F02D 1/06* (2006.01)

(52) U.S. Cl. ..... 239/5; 239/96; 239/124; 239/533.4; 239/533.5; 239/585.1; 123/496

(58) Field of Classification Search ..... 239/88–92, 239/96, 124, 533.4, 533.5, 533.9, 585.1, 239/5, 584; 123/496
See application file for complete search history.

(56) References Cited

U.S. PATENT DOCUMENTS 2,959,360 A 11/1960 Nichols
3,669,360 A 6/1972 Knight
3,718,283 A 2/1973 Fenne
3,747,857 A 7/1973 Fenne
3,817,456 A 6/1974 Schlappkohl
4,258,883 A 3/1981 Hofmann et al.
4,367,846 A * 1/1983 Akagi ..... 239/96
4,368,847 A 1/1983 Ersfeld
4,566,635 A 1/1986 Trachte
4,613,081 A 9/1986 Bauer
4,616,781 A 10/1986 Gaskell
4,798,186 A 1/1989 Ganser
4,804,143 A 2/1989 Thomas
4,811,715 A 3/1989 Djordjevic et al.
4,889,288 A 12/1989 Gaskell
4,909,444 A 3/1990 Sczomak
4,993,926 A 2/1991 Cavanagh
5,020,500 A 6/1991 Kelly
5,029,568 A 7/1991 Perr
5,042,445 A 8/1991 Peters et al.
5,463,996 A 11/1995 Maley et al.
5,505,384 A * 4/1996 Camplin ..... 239/533.5
5,588,412 A 12/1996 Nozaki
5,647,536 A 7/1997 Yen et al.
5,676,114 A 10/1997 Tarr et al.
5,738,075 A 4/1998 Chen et al.
5,769,319 A 6/1998 Yen et al.

(Continued)

*Primary Examiner*—Steven J. Ganey
(74) *Attorney, Agent, or Firm*—Nixon Peabody LLP; Tim L. Brackett, Jr.; J. Bruce Schelkopf

(57) ABSTRACT

A closed nozzle fuel injector is provided which effectively controls the fuel injection flow rate, especially during an initial portion of an injection event, while also permitting accurate control over pilot and/or post injection flow rates at all operating conditions thereby advantageously reducing emissions and combustion noise. The injector includes a rate shaping orifice to restrict fuel flow during an initial portion of an injection event and a rate shaping sleeve mounted for movement to cause a greater flow of injection fuel during a later portion of the injection event. A damping chamber and orifice are also provided to control movement of the rate shaping sleeve.

20 Claims, 7 Drawing Sheets

U.S. PATENT DOCUMENTS 5,860,597 A * 1/1999 Tarr ..... 239/124
5,899,389 A * 5/1999 Pataki et al. ..... 239/88
6,109,542 A 8/2000 Morris et al.
6,196,472 B1 3/2001 Cooke
6,293,254 B1 9/2001 Crofts et al.
6,557,776 B2 5/2003 Carroll, III et al.
6,557,779 B2 * 5/2003 Perr et al. ..... 239/96
6,637,675 B2 10/2003 Carroll, III et al.
6,705,543 B2 * 3/2004 Carroll et al. ..... 239/96

* cited by examiner

FUEL INJECTOR WITH INJECTION RATE CONTROL

BACKGROUND OF THE INVENTION

1. Technical Field

This invention relates to an improved fuel injector which effectively controls the flow rate of fuel injected into the combustion chamber of an engine.

2. Description of Related Art

In most fuel supply systems applicable to internal combustion engines, fuel injectors are used to direct fuel pulses into the engine combustion chamber. A commonly used injector is a closed-nozzle injector which includes a nozzle valve assembly having a spring-biased nozzle or needle valve element positioned adjacent the needle orifices for resisting blow back of exhaust gas into the pumping or metering chamber of the injector while allowing fuel to be injected into the cylinder. The needle valve element also functions to provide a deliberate, abrupt end to fuel injection thereby preventing a secondary injection which causes unburned hydrocarbons in the exhaust. The needle valve element is positioned in a nozzle cavity and biased by a nozzle spring to block fuel flow through the injector orifices. In many fuel systems, when the pressure of the fuel within the nozzle cavity exceeds the biasing force of the nozzle spring, the needle valve element moves outwardly to allow fuel to pass through the injector orifices, thus marking the beginning of injection. In another type of system, such as disclosed in U.S. Pat. No. 5,676,114 to Tarr et al., the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector.

Internal combustion engine designers have increasingly come to realize that substantially improved fuel injection systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices in closed nozzle fuel injector systems. One method of controlling the initial rate of fuel injection is to spill a portion of the fuel to be injected during the injection event. For example, U.S. Pat. No. 5,647,536 to Yen et al. discloses a closed nozzle injector which includes a spill circuit formed in the needle valve element for spilling injection fuel during the initial portion of an injection event to decrease the quantity of fuel injected during this initial period thus controlling the rate of fuel injection. A subsequent unrestricted injection flow rate is achieved when the needle valve moves into a position blocking the spill flow causing a dramatic increase in the fuel pressure in the nozzle cavity.

U.S. Pat. Nos. 4,811,715 to Djordjevic et al. and 3,747,857 to Fenne each disclose a fuel delivery system for supplying fuel to a closed nozzle injector which includes an expandable chamber for receiving a portion of the high pressure fuel to be injected. The diversion or spilling of injection fuel during the initial portion of an injection event decreases the quantity of fuel injected during this initial period thus controlling the rate of fuel injection. A subsequent unrestricted injection flow rate is achieved when the expandable chamber becomes filled causing a dramatic increase in the fuel pressure in the nozzle cavity. Therefore these devices rely on the volume of the expandable chamber to determine the beginning of the unrestricted flow rate. Moreover, the use of a separate expandable chamber device mounted on or near an injector increases the costs, size and complexity of the injector. U.S. Pat. No. 5,029,568 to Perr discloses a similar injection rate control device for an open nozzle injector.

U.S. Pat. Nos. 4,804,143 to Thomas and 2,959,360 to Nichols disclose other fuel injector nozzle assemblies incorporating passages in the nozzle assembly for diverting the fuel from the nozzle assembly. The injection nozzle unit disclosed in Thomas includes a restricted passage formed in the injector adjacent the nozzle valve element for directing fuel from the nozzle cavity to a fuel outlet circuit. However, the restricted passage is used to maintain fuel flow through the nozzle unit so as to effect cooling. The Thomas patent nowhere discusses or suggests the desirability of controlling the injection rate. Moreover, the restricted passage is closed by the nozzle valve element upon movement from its seated position to prevent diverted flow during injection. The fuel injector disclosed in Nichols includes a nozzle valve element having an axial passage formed therein for diverting fuel from the nozzle cavity into an expansible chamber formed in the nozzle valve element. A plunger is positioned in the chamber to form a differential surface creating a fuel pressure induced seating force on the nozzle valve element to aid in rapidly seating the valve element. The Nichols reference does not suggest the desirability of controlling the rate of injection.

U.S. Pat. No. 4,993,926 to Cavanagh discloses a fuel pumping apparatus including a piston having a passage formed therein for connecting a chamber to an annular groove for spilling fuel during an initial portion of an injection event. The piston includes a land which blocks the spill of fuel after the initial injection stage to permit the entirety of the fuel to be injected into the engine cylinder. However, this device is incorporated into a piston pump positioned upstream from an injector.

Another method of reducing the initial volume of fuel injected during each injection event is to reduce the pressure of the fuel delivered to the nozzle cavity during the initial stage of injection. For example, U.S. Pat. No. 5,020,500 to Kelly discloses a closed nozzle injector including a passage formed between the nozzle valve element and the inner surface of the nozzle cavity for restricting or throttling fuel flow to the nozzle cavity so as to provide rate shaping capability. U.S. Pat. No. 4,258,883 issued to Hoffman et al. discloses a similar fuel injection nozzle including a throttle passage formed between the nozzle valve element and a separate control supply valve for restricting fuel flow into the nozzle cavity thus limiting the pressure increase in the cavity and the rate of injection fuel flow through the injector orifices.

U.S. Pat. Nos. 3,669,360 issued to Knight, 3,747,857 issued to Fenne, and 3,817,456 issued to Schlappkohl all disclose closed nozzle injector assemblies including a high pressure delivery passage for directing high pressure fuel to the nozzle cavity of the injector and a throttling orifice positioned in the delivery passage for creating an initial low rate of injection. Moreover, the devices disclosed in Knight and Schlappkohl include a valve means operatively connected to the nozzle valve element which provides a substantially unrestricted flow of fuel to the nozzle cavity upon movement of the nozzle valve element a predetermined distance off its seat.

U.S. Pat. Nos. 3,718,283 issued to Fenne and 4,889,288 issued to Gaskell disclose fuel injection nozzle assemblies including other forms of rate shaping devices. For example, Fenne '283 uses a multi-plunger and multi-spring arrangement to create a two-stage rate shaped injection. The Gaskell reference uses a damping chamber filled with a damping fluid for restricting the movement of the nozzle valve element.

Although the systems discussed hereinabove create different stages of injection, further improvement in injector simplicity and rate shaping effectiveness is desirable.

SUMMARY OF THE INVENTION

One advantage of the present invention is in providing a cost effective, efficient, flexible and responsive injector and method of controlling fuel injection rate.

Another advantage of the present invention is in producing a commercially viable system to produce multiple fuel injection mass flow rates from a common source of pressurized fuel.

Yet another advantage of the present invention is in being compatible with existing fuel systems.

A still further advantage of the present invention is in providing a wide variety of rate shape choices.

Still another advantage of the present invention is to provide a fuel injector and fuel system capable of reducing nitrous oxides, particulates and combustion noise while also improving brake specific fuel consumption.

The above advantages and other advantages are achieved by providing the closed nozzle fuel injector of the present invention for injecting fuel at high pressure into the combustion chamber of an engine, comprising an injector body containing an injector cavity and an injector orifice communicating with one end of the injector cavity to discharge fuel into the combustion chamber. The injector also includes a fuel transfer circuit at least partially formed in the injector body to deliver supply fuel to the injector orifice, wherein the fuel transfer circuit including a first circuit and a second circuit in parallel with the first circuit. The injector also includes a nozzle valve element positioned in the injector cavity adjacent the injector orifice. The nozzle valve element is movable between an open position in which fuel may flow through the injector orifice into the combustion chamber and a closed position in which fuel flow through the injector orifice is blocked. Importantly, the injector includes a rate shaping sleeve mounted on the nozzle valve element for movement between a first position blocking flow through the second circuit and a second position permitting flow through the second circuit. The rate shaping sleeve includes a valve surface positioned in sealing contact with the nozzle valve element when the rate shaping sleeve is in the first position to block flow through the second circuit.

The rate shaping sleeve may include an inner distal end positioned axially along the injector body between the valve surface and the injector orifice. The injector may further include a bias spring positioned to bias the rate shaping sleeve away from the injector orifice into the first position. The rate shaping sleeve may be biased into other first position in abutment against a sleeve valve seat formed on the nozzle valve element. The rate shaping sleeve may be biased into the first position in abutment against a sleeve stop. The sleeve stop may be formed integrally on a spring retainer positioned for abutment by a nozzle bias spring. In one embodiment, the valve surface of the rate shaping sleeve is positioned in positive sealing abutment against the nozzle valve element to create the sealing contact when the rate shaping sleeve is in the first position. In another embodiment, the valve surface of the rate shaping sleeve is positioned for sliding movement against the rate shaping sleeve to create the sealing contact at a fluidically sealed sliding interface when the rate shaping sleeve is in the first position.

The first circuit of the fuel transfer circuit may include a rate shaping orifice formed in, and extending through, the rate shaping sleeve. The injector may further include a damping chamber positioned to receive fuel to restrict movement of the rate shaping sleeve from the first position toward the second position and a damping orifice to restrict fuel flow out of the damping chamber.

These and other advantages and features of the present invention will become more apparent from the following detailed description of the preferred embodiments of the present invention when viewed in conjunction with the accompanying drawings.

DETAILED DESCRIPTION OF THE PREFERRED EMBODIMENT

Figure 1:
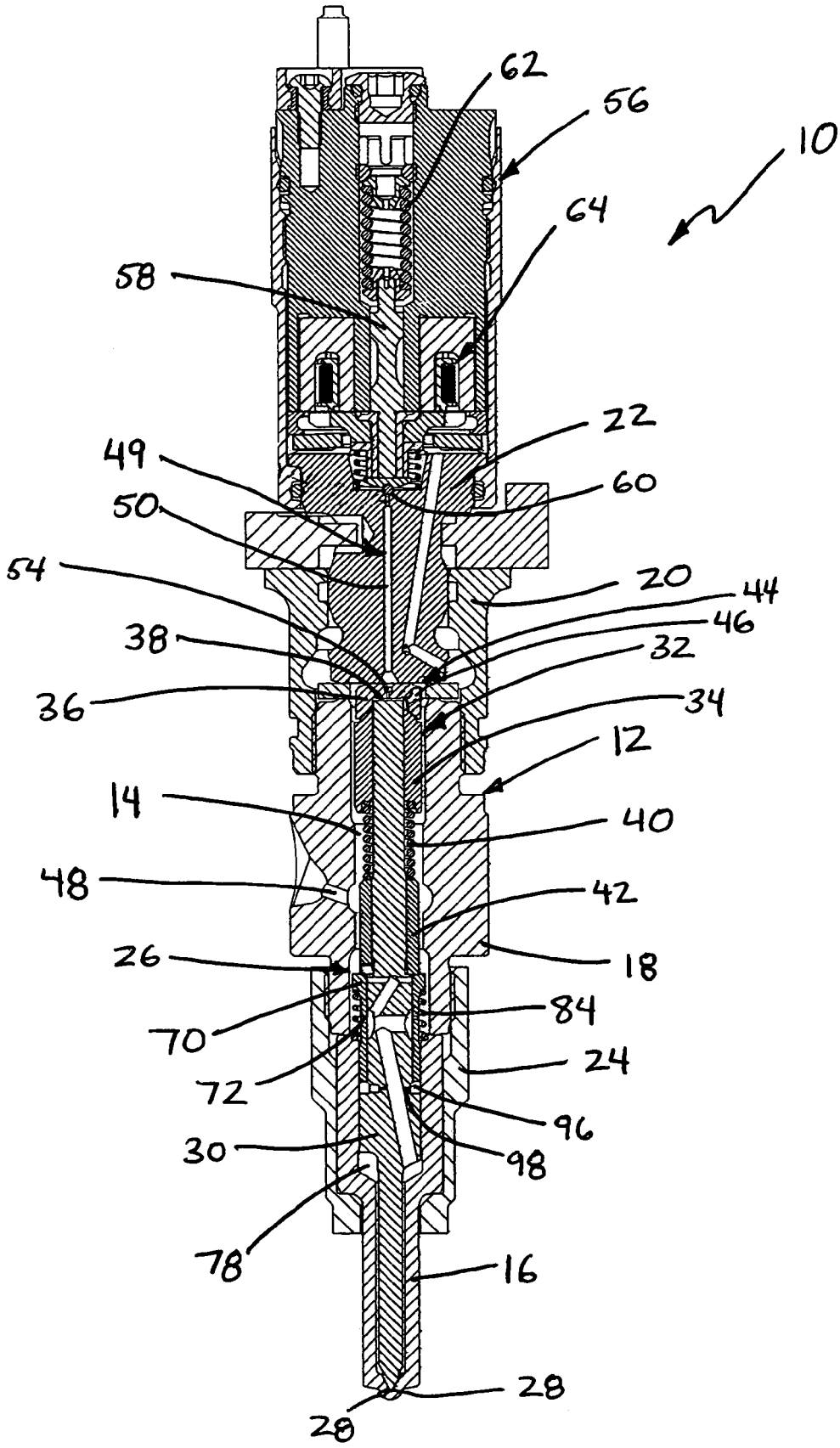
FIG. 1 is a cross sectional view of an exemplary embodiment of the fuel injector of the present invention.

Referring to FIG. 1, there is shown an exemplary embodiment of the closed nozzle fuel injector of the present invention, indicated generally at 10, which functions to effectively control the fuel injection flow rate, especially during an initial portion of an injection event, while also permitting accurate control over pilot and/or post injection events and flow quantities at all operating conditions thereby ultimately advantageously reducing emissions and combustion noise while improving brake specific fuel consumption. Closed nozzle injector 10 is generally comprised of an injector body 12 having a generally elongated, cylindrical shape which forms an injector cavity 14. The injector body 12 includes a cup 16, an inner barrel 18, an outer barrel 20, a support 22 and a retainer 24. Retainer 24 threadably engages inner barrel 18 to hold cup 16 and inner barrel 18 in a compressive abutting relationship by simple relative rotation of retainer 24 and inner barrel 18. Outer barrel 20 threadably engages the upper end of inner barrel 18.

Fuel injector 10 further includes a fuel transfer circuit 26 for delivering fuel to, and through, injector cavity 14. Injector body 12 also includes a plurality of injector orifices 28 fluidically connecting injector cavity 14 with a combustion chamber of an engine (not shown). Injector 10 further includes a nozzle valve element 30 reciprocally mounted in injector cavity 14 for opening and closing injector orifices 28 thereby controlling the flow of injection fuel into an engine combustion chamber. Specifically, nozzle valve element 30 is movable between an open position in which fuel may flow through injector orifices 28 into the combustion chamber and a closed position in which an inner end of nozzle valve element 30 is positioned in sealing abutment against a valve seat formed on cup 16 so as to block fuel flow through injector orifices 28. A floating sleeve 32 is positioned on the outer end of nozzle valve element 30 and comprised of a main sleeve section 34 and a sleeve seal section 36 which wraps around the end of nozzle valve element 30 to form a control volume 38. A nozzle spring 40 is positioned in injector cavity 14 so that its outer end is positioned in abutment against the lower end of main sleeve section 34 to bias main sleeve section 34 against sleeve seal section 36 and thus bias sleeve seal section 36 into sealing abutment with support 22. The inner end of nozzle spring 40 is positioned in abutment against a spring retainer 42 mounted on nozzle valve element 30. The inner end of spring retainer 42 is positioned in abutment against an annular land formed on nozzle valve element 30 so that nozzle spring 40 biases nozzle valve element 30 into its closed position. The structure and function of floating sleeve 32 is also described in U.S. Pat. No. 6,293,254 issues to Crofts et al., the entire contents of which is hereby incorporated by reference.

Injector 10 also includes a charge circuit 44 including a charge passage 46 integrally formed in sleeve seal section 36 so as to deliver high pressure fuel from a fuel inlet 48 to control volume 38. Charge passage 46 includes an orifice that limits the quantity of fuel that can flow through the charge passage. A drain circuit 49 includes a drain passage 50 extending through support 22 and a drain orifice 54 formed in sleeve seal section 36 to more accurately control the drain flow through the drain circuit 49. Injector 10 also includes an injection control valve 56 for controlling the flow of fuel through drain circuit 49. Injection control valve 56 includes a control valve element 58 biased by a bias spring 62, into a closed position against a valve seat 60 formed on support 22. Injection control valve 56 also includes a solenoid assembly 64 which is actuated and de-actuated to move control valve element 58 between open and closed positions to thereby control the flow of fuel from control volume 38. Injection control valve 56 may include any conventional actuator assembly capable of selectively controlling the movement of injection control valve element 58. For example, in an alternative embodiment, injection control valve 56 may include a piezoelectric or magnetostrictive-type actuator assembly.

Figure 2A:
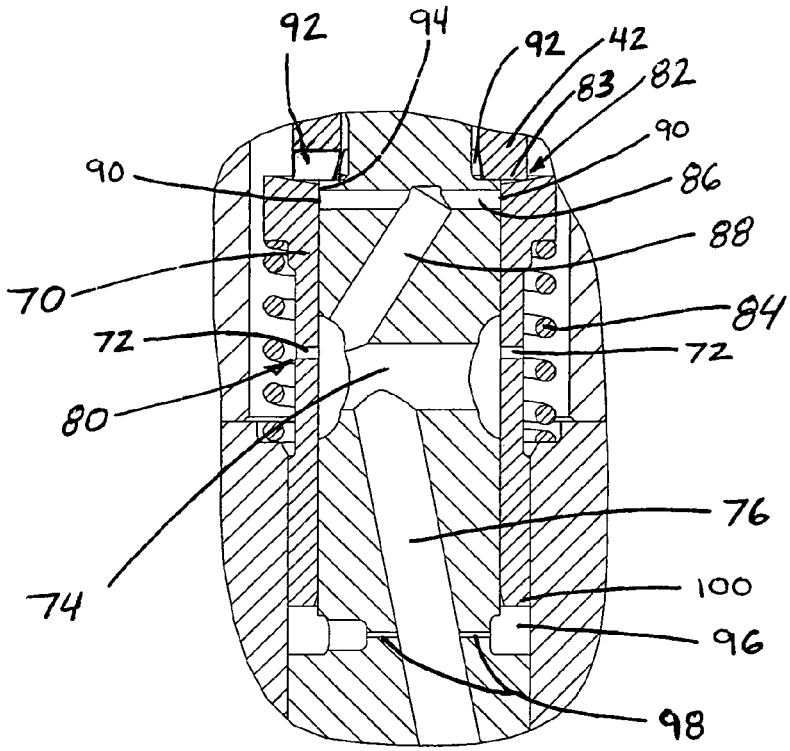
FIGS. 2A and 2B are expanded cut-away views of a portion of the injector of FIG. 1 with the rate shaping sleeve in the closed and open positions, respectively.
Figure 2B:
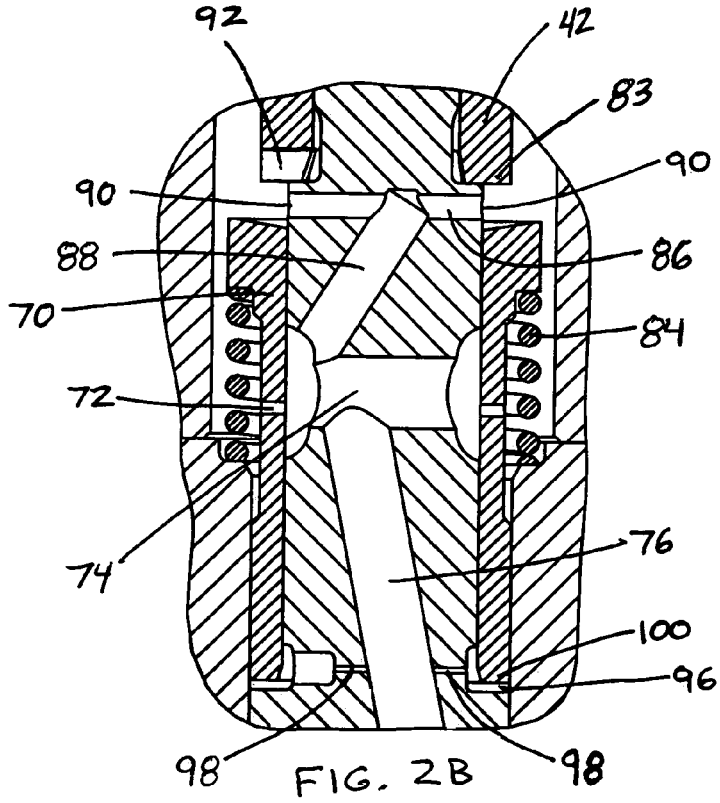

Injector 10 of the present invention also includes a rate shaping sleeve 70 and may include a rate shaping orifice 72, as best shown in FIGS. 2A and 2B, for creating a reduced injection flow rate during an initial portion of an injection event followed by a higher injection flow rate in a simple and effective manner. Rate shaping orifice 72, as described more fully hereinbelow, permits a limited or restricted flow of fuel through fuel transfer circuit 26 during an initial portion of an injection event followed by a movement of rate shaping sleeve 70 to permit a greater flow of fuel through fuel transfer circuit 26 to injector orifices 28 for injection.

Fuel transfer circuit 26 includes the injector cavity 14 surrounding nozzle valve element 30, spring retainer 42 and rate shaping sleeve 70. Fuel transfer circuit 26 also includes a transverse passage 74, a cross passage 76 and a nozzle cavity volume 78. In addition, fuel transfer circuit 26 includes a first circuit 80 permitting restricted flow from the injector cavity into the passages formed in nozzle valve element 30 and a second circuit 82 formed in parallel to first circuit 80 to prevent an additional flow of fuel from the injector cavity for injection. Specifically, first circuit 80 includes rate shaping orifice 72, which is formed in rate shaping sleeve 70, to permit fuel flow from injector cavity 14 surrounding rate shaping sleeve 70 into transverse passage 74. In the exemplary embodiment of FIGS. 2A and 2B, rate shaping orifice 72 is formed as a transverse passage extending through both walls of rate shaping sleeve 70 on opposite sides of the sleeve. In alternative embodiments, rate shaping orifice may be positioned elsewhere along the sleeve, may include only one passage extending through one wall, any larger number of passages, and/or may extend at a different angle through the wall of the sleeve. In any case, rate shaping orifice 72 is sized to provide a restriction to the flow through first circuit 80 so as to create a pressure drop across orifice 72 which not only limits the flow for injection but also creates a force acting on rate shaping sleeve 70 which together with other forces results in a net force causing rate shaping sleeve 70 to move from the closed position shown in FIG. 2A to an open position shown in FIG. 2B as described more fully hereinbelow.

Rate shaping sleeve 70 is generally cylindrically shaped and mounted on the outer surface of nozzle valve element 30. The outer end of rate shaping sleeve 70 is positioned in abutment against a sleeve stop 83, integrally formed on the inner end of spring retainer 42, when rate shaping sleeve 70 is in its outer most closed position. Rate shaping sleeve 70 is biased into the closed position against spring retainer 42 by a sleeve bias spring 84. Spring 84 is positioned against the injector body at its inner end and against a land formed on rate shaping sleeve at its outer end.

Second circuit 82 of fuel transfer circuit 26 includes a cross passage 86 formed in nozzle valve element 30 and a diagonal passage 88 extending from cross passage 86 inwardly to communicate with transverse passage 74. Each end of cross passage 86 forms a flow port 90 positioned axially along nozzle valve element 30 so as to be covered or blocked by rate shaping sleeve 70 when sleeve 70 is in its fully outer position, i.e. closed or blocked position, as shown in FIG. 2A. The lower end of spring retainer 42 includes at least one, and preferably a plurality, of grooves 92 to permit fuel flow past the seating interface of sleeve 70 and spring retainer 42 so that the entire outer end face of sleeve 70 is exposed to injection fuel when sleeve 70 is in its outermost, closed position. Rate shaping sleeve 70 includes a valve surface 94 positioned annularly around its inside surface adjacent its outer end. Valve surface 94 moves to open and close ports 90 to control fuel flow through second circuit 82. Specifically, as shown in FIG. 2A, when rate shaping sleeve 70 is in its outermost position against the sleeve stop 83, valve surface 94 blocks flow through ports 90. However, during operation as described more fully herein below, when rate shaping sleeve 70 moves inwardly, valve surface 94 moves until its outer edge uncovers ports 90 to permit fuel flow into cross passage 86.

Fuel injector 10 of the present invention also includes a damping volume or chamber 96 and a damping orifice 98 for slowing the movement of rate shaping sleeve 70 from the closed position to the open position. In the exemplary embodiment of FIGS. 2A and 2B, damping chamber 96 is in the form of an annular volume positioned adjacent an inner distal end 100 of rate shaping sleeve 70. Damping orifice 98 is in the form of a transverse passage extending through nozzle valve element 30 to connect the damping chamber 96 with cross passage 76. Damping orifice 98 is sized to restrict the flow of fuel from damping chamber 96 to cross passage 76 as rate shaping sleeve 70 moves inwardly into an open position thereby increasing the pressure in damping chamber 96 and slowing the movement of rate shaping sleeve 70.

Figure 3:
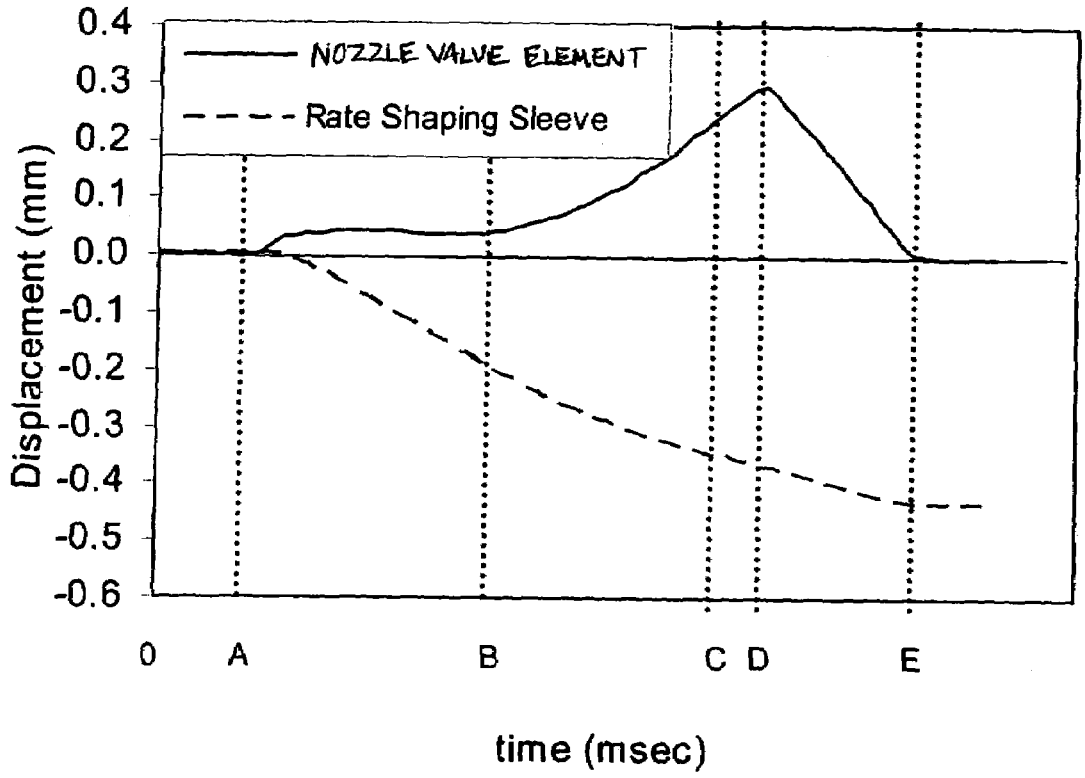
FIG. 3 is a graph showing displacement of the nozzle valve element and the rate shaping sleeve during an injection event.
Figure 4:
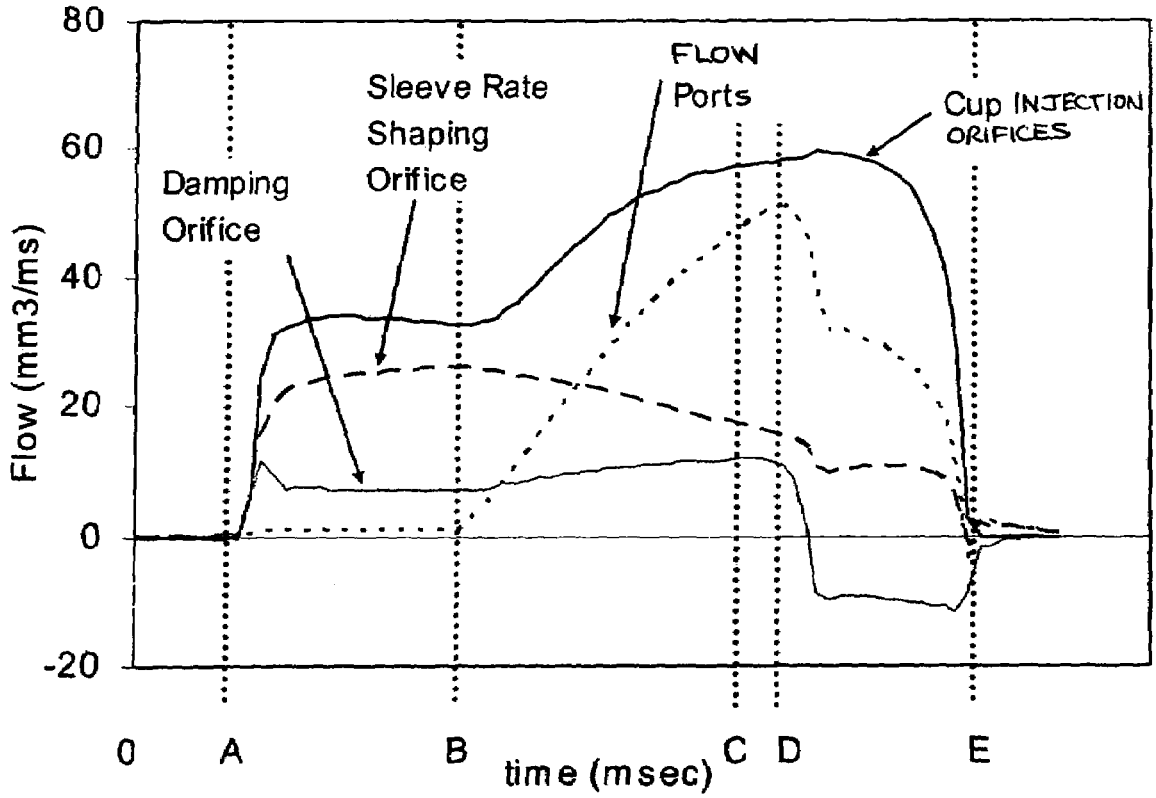
FIG. 4 is a graph showing injection fuel flow through various passages of the injector of FIG. 1 during an injection event.

The operation of injector 10 will now be described. Referring to FIGS. 1 and 2A, with injection control valve 56 actuated and in the closed position, control valve element 58 is seated against valve seat 60 blocking flow from drain circuit 49. As a result, the fuel pressure level experienced at fuel inlet 48 and injector cavity 14 is also present in control volume 38. With the fuel pressure in control volume 38 and injector cavity 14 being equal, the fuel pressure forces acting inwardly on nozzle valve element 30, in combination with the bias force of spring 40, maintain nozzle valve element 30 in its closed position blocking flow through injector orifices 28 as shown in FIG. 2A. At a predetermined time during engine operation, injector control valve 56 is actuated to controllably move control valve element 58 from the closed position to an open position thereby allowing the flow of fuel from control volume 38 through drain orifice 54 and drain passage 50 to a low pressure drain. Simultaneously, high pressure fuel flows from charge passage 46 into control volume 38 which immediately results in a pressure drop across the charge passage or orifice 46. As a result, the pressure in control volume 38 immediately decreases below the pressure in the upstream injector cavity 14. The relative size of charge passage/orifice 46 and drain orifice 54 can be selected to optimize the flow out of drain passage 50 which in turn will increase or decrease the pressure in control volume 38 and thus the rate of change of the control volume pressure as desired. Fuel pressure forces acting on nozzle valve element 30 due to high pressure fuel in injector cavity 14 begin to move nozzle valve element 30 outwardly against the bias force of nozzle spring 40 into an open position with the inner end of nozzle valve element 30 lifted from its valve seat formed on cup 16 thereby initiating injection. As fuel is removed from the fuel volumes downstream of rate shaping orifice 72, including nozzle cavity volume 78, cross passage 76 and transverse passage 74, the fuel pressure drops in all these fuel volumes downstream of rate shaping orifice 72. As a result of this initial pressure decrease, the net forces on nozzle valve element 30 cause nozzle valve element 30 to be only slightly lifted off its seat adjacent injector orifices 28. Initially, sleeve bias spring 84 maintains rate shaping sleeve 70 in its outermost position against sleeve stop 83 thereby blocking flow through second circuit 82. However, the pressure differential between the fuel volume in injector cavity 14 upstream of rate shaping orifice 72 and the fuel volume downstream of rate shaping orifice 72, in large part due to fuel pressure forces acting on the outermost end surface of rate shaping sleeve 70, causes rate shaping sleeve 70 to move inwardly/downwardly against sleeve bias spring 84. This downward motion of rate shaping sleeve 70 is retarded by damping orifice 98 which restricts the fuel flow out of damping chamber 96 causing an increase in pressure in the damping chamber 96 relative to the pressure in the nozzle cavity volume 78 and thus a force resisting the downward movement of the sleeve. FIG. 3 illustrates the displacement of both the rate shaping sleeve and the nozzle valve element at different times during the injection event. The injection flow rate through injection orifices 28 is approximately equal to the sum of the flow through rate shaping orifice 72 and damping orifice 98 as shown in FIG. 4.

The rate shaping sleeve 70 continues to move downward relative to the nozzle valve element 30. The upper edge of the valve surface 94 of the rate shaping sleeve 70 uncovers flow port 90 as indicated at B in FIG. 3. The assembled, present distance from the sleeve stop 83 to the flow port 90 functions to control the timing of the uncovering of the ports 90. Consequently, the fuel flow through second circuit 82 is initiated as fuel flows into ports 90, cross passage 86, diagonal passage 88 and transverse passage 74 to combine with the fuel flowing through rate shaping orifice 72 of first circuit 80 as shown in FIG. 2B. As a result, the fuel pressure in nozzle cavity volume 78 increases which increases the net force acting to lift nozzle valve element 30 from its seat. Thus, a higher injection flow rate occurs following the initial lower fuel injection flow rate as shown in FIG. 4.

At a predetermined time during the injection event, injection control valve 56 is de-actuated causing control valve element 58 to move into the closed position blocking flow through drain circuit 49 and thus causing pressurization of control volume 38 to injection pressure. As a result, nozzle valve element 30 begins to move toward its seated, closed position. This time is identified as C in FIG. 3 and FIG. 4. The downward motion of rating shaping sleeve 70 is retarded by damping orifice 98 which restricts the fuel flow out of damping volume 96. Since the fuel pressure in injector cavity 14 continues to exceed the pressure in damping chamber 96, rate shaping sleeve 70 continues to move downward as shown in FIG. 3. Subsequently, nozzle element 30 moves into its seated, closed position terminating the injection event. After seating of nozzle valve element 30 in its closed position labeled as E in FIG. 3 and FIG. 4, sleeve bias spring 84 then moves rate shaping sleeve 70 back into its outermost position against sleeve stop 83.

Figure 5:
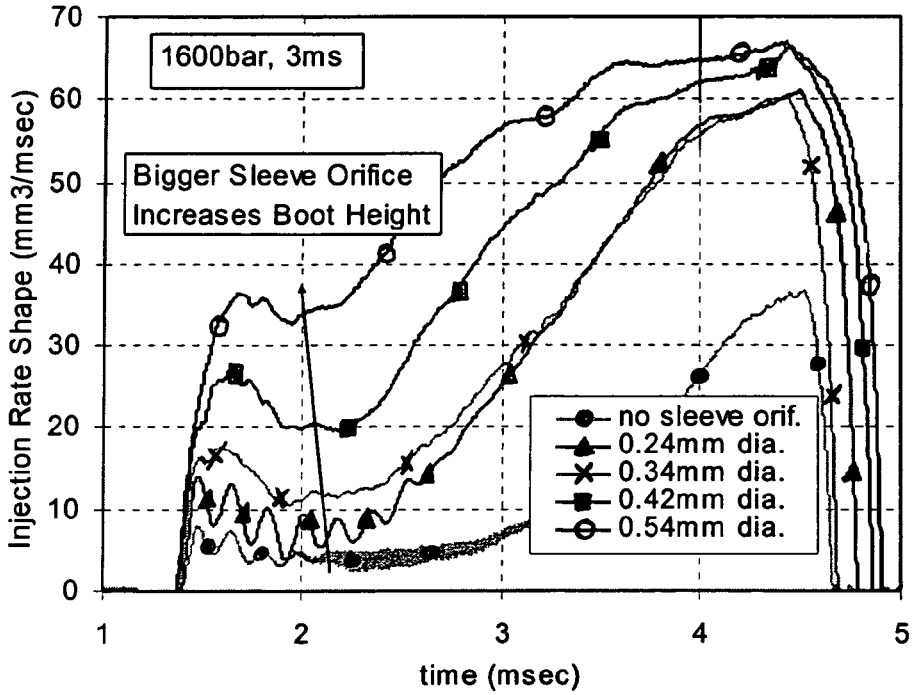
FIG. 5 is a graph showing injection fuel flow rate shapes from the injector orifices by the injector of FIG. 1 for different sized rate shaping orifices.
Figure 6:
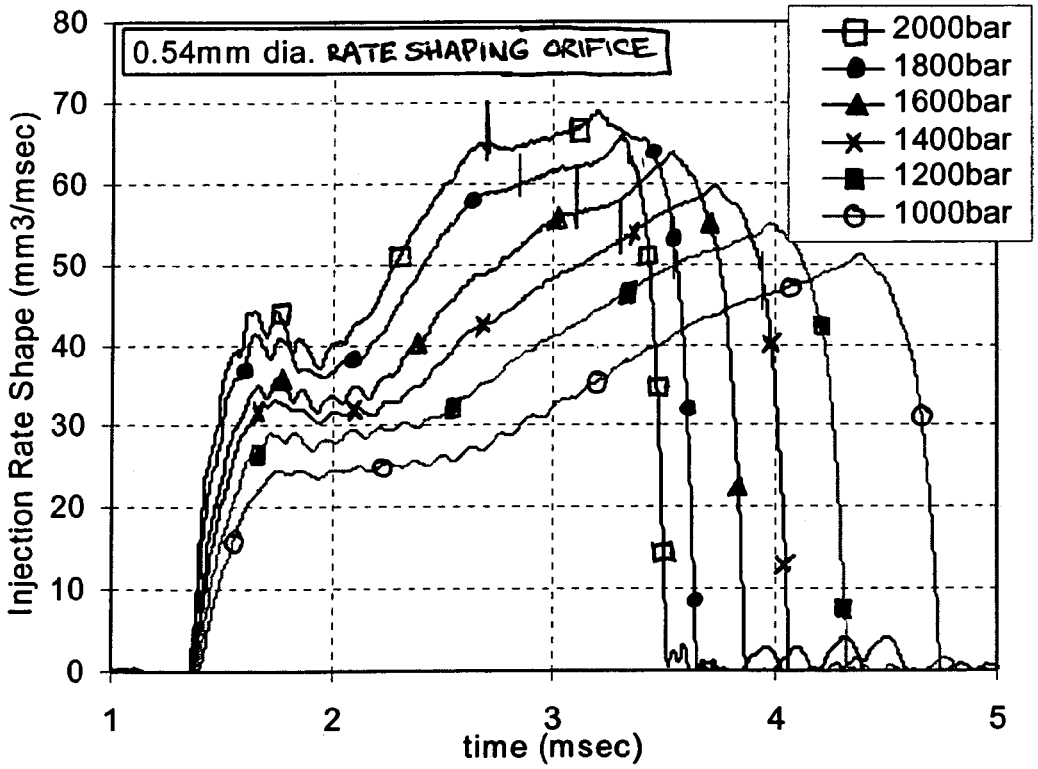
FIG. 6 is a graph showing injection fuel flow rate shapes by the injector of FIG. 1 for different injection supply pressures.

FIG. 5 illustrates the affects of varying the size of rate shaping orifice 72 on the flow rate of fuel throughout the injection event and thus the injection rate shape. As shown, the larger the rate shaping orifice 72, the greater the amount of fuel injected during the initial portions of the event and the larger the "boot" height of the injection rate shape, and the shorter the duration of the reduced fuel delivery. FIG. 6 illustrates the effect of increasing the injection pressure on the injection rate shape.

Figure 7:
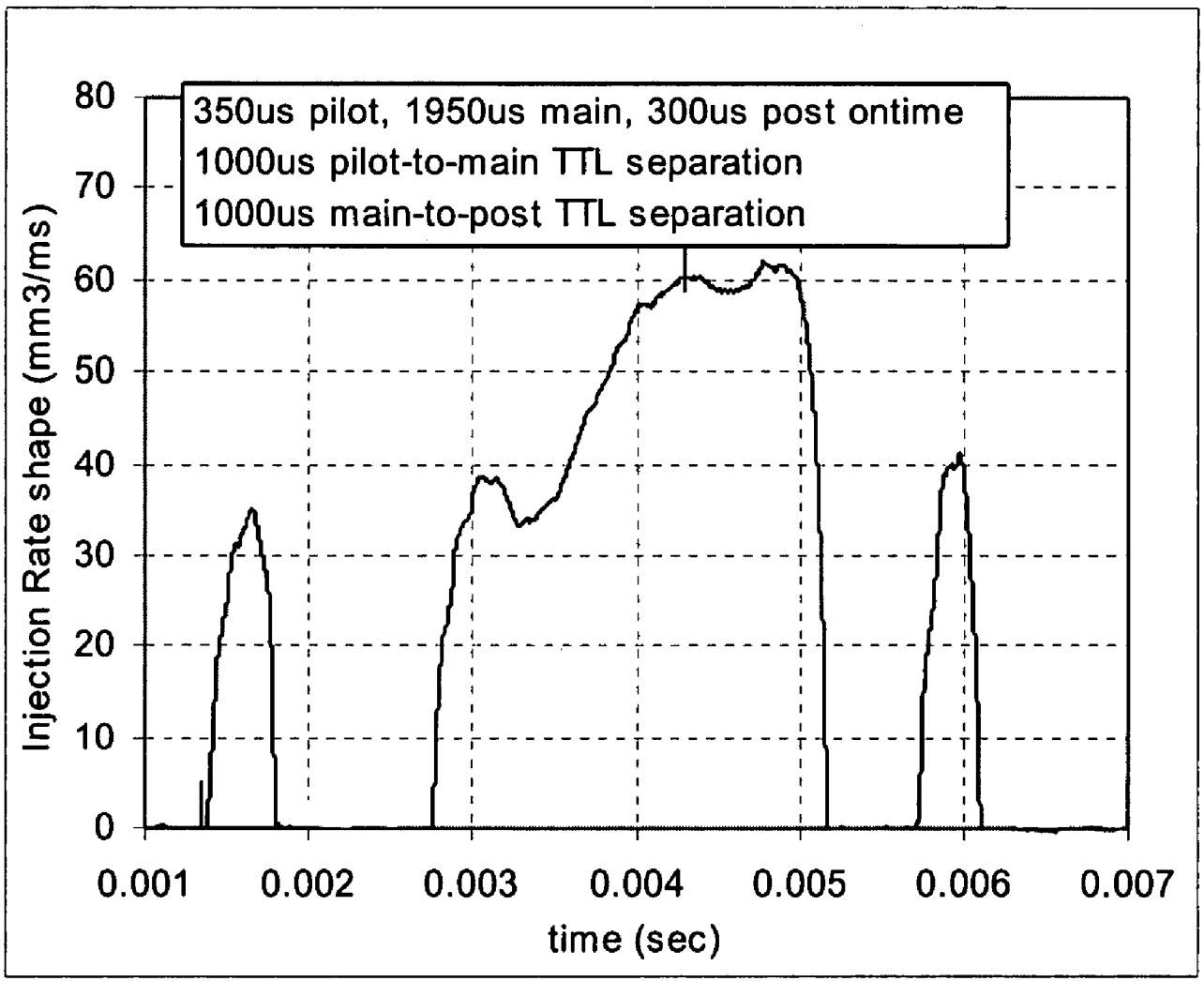
FIG. 7 is a graph showing the injection rate shape for pilot, main and post injection events for a single multi-event injection.

Injector 10 of the present invention may also be operated to include a pilot injection and/or a post injection in combination with the main injection event as shown in FIG. 7. The pilot injection event is of such a short duration that the nozzle valve element 30 moves from the closed to the open position and back to the closed position before any movement of rate shaping sleeve 70 can occur. If the post injection event is commanded after the reseating of rate shaping sleeve 70 against spring retainer 42, then the post injection event will have the same rate shaping characteristics as the main injection event. If the post injection event, however is commanded before rate shaping sleeve 70 covers flow ports 90 after the end of the main injection event, then the post injection event will begin at a high injection rate with fuel flow from both first circuit 80 and second circuit 82.

Figure 8:
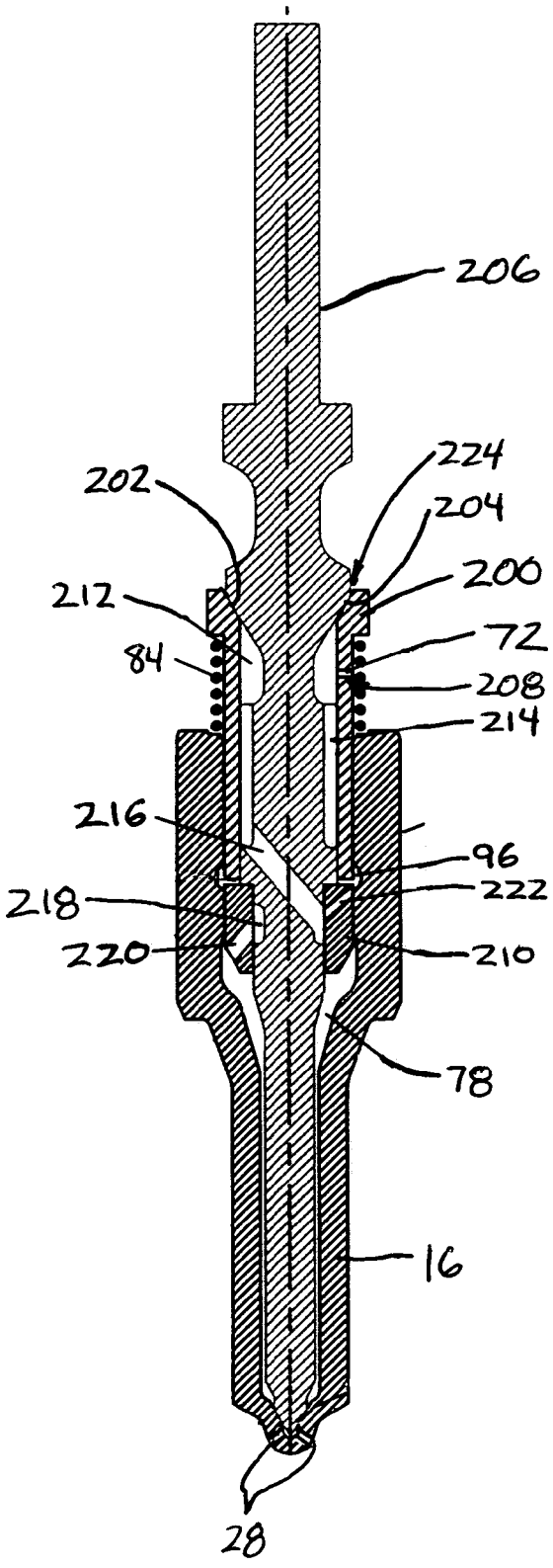
FIG. 8 is a cross sectional view of the nozzle valve assembly of a second exemplary embodiment of the injector of the present invention.

Now referring to FIG. 8, another embodiment of the present invention is shown which includes a rate shaping sleeve 200 having a sleeve valve surface 202 which is biased into positive sealing abutment against a valve seat 204 formed on nozzle valve element 206. It should be noted that only the nozzle valve assembly of the present embodiment is shown in FIG. 8 because the remainder of the injector is the same as the previous embodiment and like components are referred to with the same reference numerals. Thus, the present embodiment includes rate shaping orifice 72 formed in rate shaping sleeve 200, a sleeve bias spring 84 and cup 16. However, a fuel transfer circuit includes a first circuit 208 including a different set of passages formed in nozzle valve element 206 and a nozzle ring 210. Nozzle ring 210 is fixedly attached to nozzle valve element 206 by, for example, an interference fit. First circuit 208 includes an annular chamber 212, a plurality of axially slots 214 formed in the outer surface of nozzle valve element 206, a cross passage 216, an annular groove 218 and a diagonal passage 220. Similar to the previous embodiment, a damping chamber 96 is positioned at the inner end of rate shaping sleeve 200 and fluidically connected to first circuit 208 by a damping passage or orifice 222 which, in this embodiment, is formed in nozzle ring 210. The fuel transfer circuit also includes a second circuit 224 including a valve interface between rate shaping sleeve 200 and nozzle valve element 206 such that rate shaping sleeve 200 controls the flow through second circuit 224.

Figure 10A:
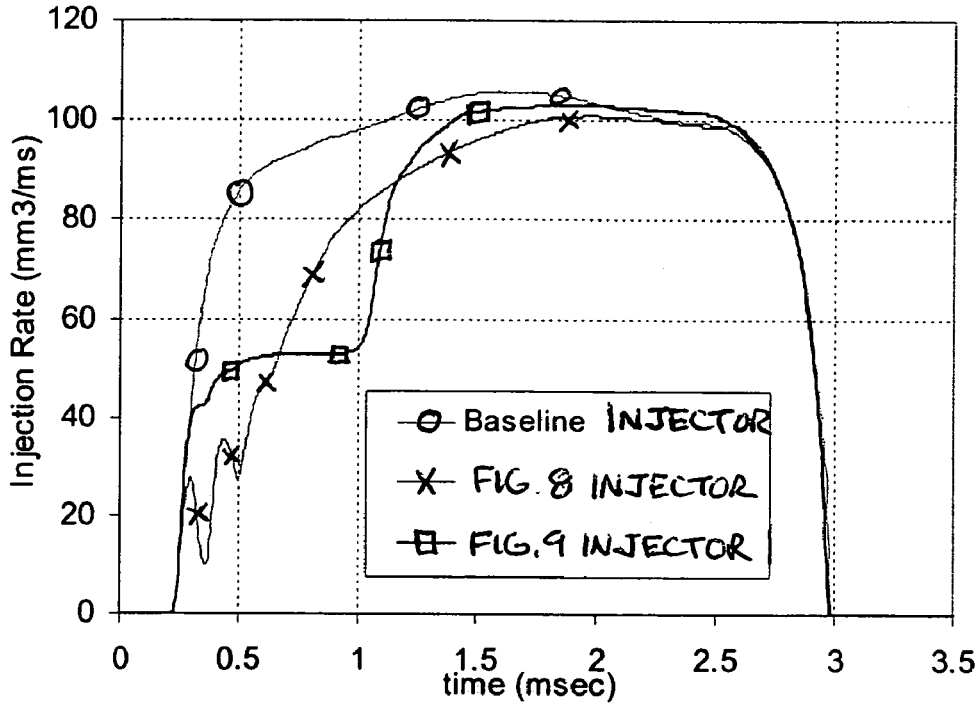
FIGS. 10A and 10B are graphs showing a comparison of the injection rate shape for a baseline injector without a rate shaping sleeve and orifice, the injector of FIG. 8 and the injector of FIG. 9.

The operation of the embodiment of FIG. 8 is essentially the same as the previous embodiment but will be explained herein briefly for clarity purposes. After actuation of the injection control valve shown in FIG. 1, as nozzle valve element 26 begins to lift off its valve seat formed on cup 16, sleeve bias spring 84 acts to initially keep rate shaping sleeve 200 in positive abutment against valve seat 204 of nozzle valve element 206. At the same time, fuel flows through rate shaping orifice 72 into annular chamber 212 and onward to nozzle cavity volume 78 via slots 214, cross passage 216, annular groove 218 and diagonal passage 220. The flow then passes through injector orifices 28 into the combustion chamber of an engine. Again, the rate shaping orifice 72 is sized to provide a flow path restriction to create a pressure drop across orifice 72 which thus creates a force acting to separate rate shaping sleeve 200 from nozzle valve element 206. When this force exceeds the force of sleeve bias spring 84, rate shaping sleeve 200 moves inwardly away from valve seat 204 of nozzle valve element 206 to create an additional flow path, i.e. second circuit 224, which acts in parallel to rate shaping orifice 72, i.e. first circuit 208. This additional flow path reduces the overall flow path restriction to orifices 28 thereby increasing the injection flow rate. The nozzle valve element opening velocity, the injection rate and injection pressure all increase as the gap between sleeve valve surface 202 and valve seat 204 increases. However, the nozzle valve element opening velocity, the injection rate and injection pressure all continue to be lower than that of a similar injector which does not have rate shaping orifice 72 and rate shaping sleeve 200. As rate shaping sleeve 200 moves relative to nozzle valve element 206, the fluid volume in the damping chamber is reduced. This displaced fluid or fuel passes through damping orifice 222 which acts to slow the relative separation of rate shaping sleeve 200 and nozzle valve element 206 by increasing the pressure in the damping chamber. In this operational phase, a gradually increasing percentage of the fuel flow passes through the variable flow area governed by the relative displacement between rate shaping sleeve 200 and nozzle valve element 206. Rate shaping is achieved by the gradual increase in this flow area. Rate shaping sleeve 200 and nozzle valve element 206 continue to separate until rate shaping sleeve 200 contacts nozzle ring 210 at which point nozzle valve element 206 continues to open. A fuel injection sequence is terminated by the de-energization of injection control valve 56 as described herein above relative to the embodiment of FIG. 1. The resulting triangular-shaped fuel injection rate shape is shown in FIG. 10A relative to a baseline injector having no rate shaping sleeve and orifice.

Figure 9:
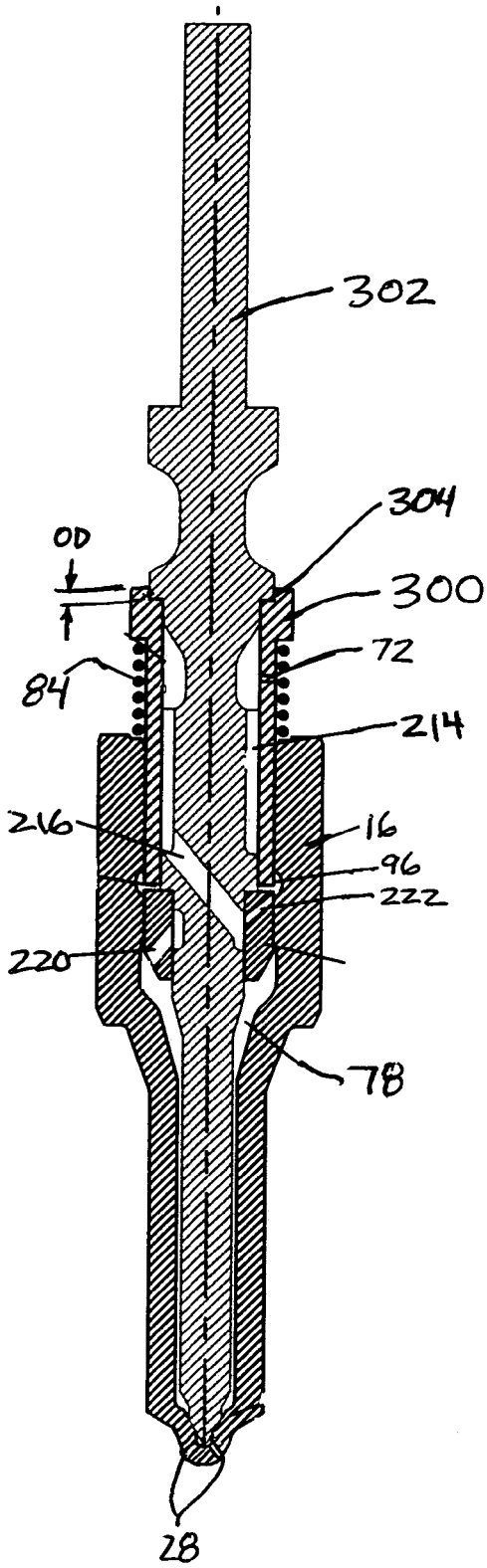
FIG. 9 is a cross sectional view of the nozzle valve assembly of a third exemplary embodiment of the injector of the present invention.
Figure 10B:
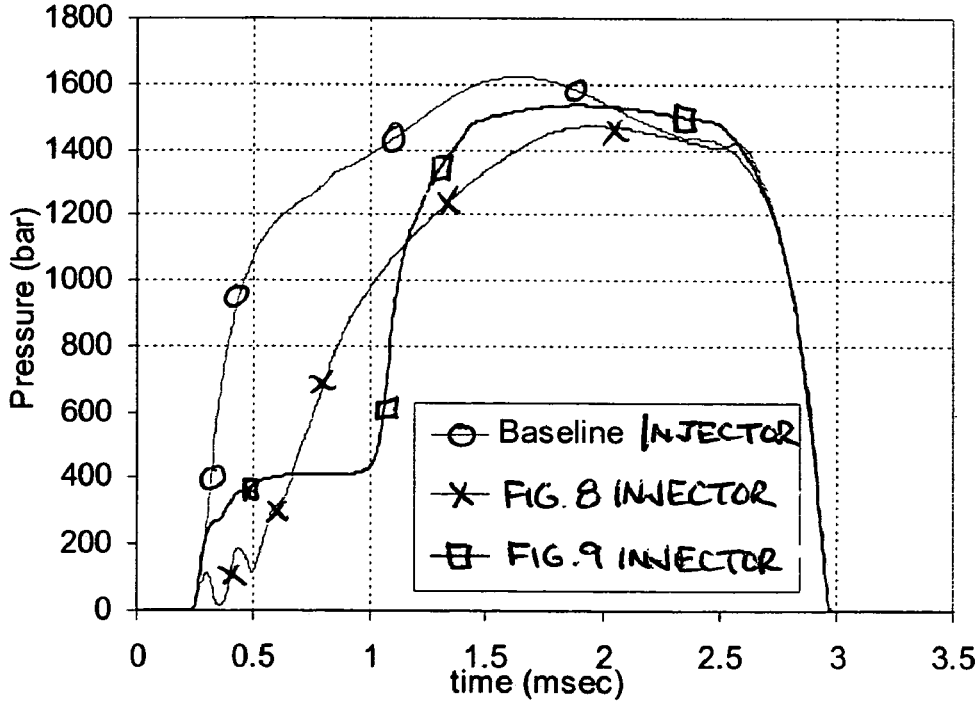

FIG. 9 illustrates yet another embodiment of the present invention which is essentially the same as the embodiment of FIG. 8 except for the different configuration at the interface of the rate shaping sleeve 300 with the nozzle valve element 302 forming the second circuit. Specifically, nozzle valve element 302 and rate shaping sleeve 300 are formed with complementary engaging lands that overlap yet positively engage to form a sealed valve interface. That is, unlike the previous embodiment of FIG. 8, movement of rate shaping sleeve 300 away from nozzle valve element 302 does not immediately open the second circuit since the outer end of rate shaping sleeve 300 includes an annular extension 304 which receives and axially overlaps an outer annular surface of nozzle valve element 302. The overlap extends a predetermined distance indicated as the overlap distance (OD). As with the previous embodiment, during the initial phase of the injection event, the pressure drop across rate shaping orifice 72 creates a force which acts to separate rate shaping sleeve 300 from nozzle valve element 302. However, in this case, relative motion of rate shaping sleeve 300 with respect to nozzle valve element 302 does not create a significant parallel flow path, i.e. second circuit, until the relative motion exceeds the overlap distance (OD). This delay in the creation of the second circuit, that is, the additional flow path parallel to rate shaping orifice 72, results in a boot-shaped injection rate and pressure profiles shown in FIGS. 10A and 10B, especially as compared to the triangular-shaped injection rate and pressure profiles of the embodiment of FIG. 8.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. A closed nozzle fuel injector for injecting fuel at high pressure into the combustion chamber of an engine, comprising:

an injector body containing an injector cavity and an injector orifice communicating with one end of said injector cavity to discharge fuel into the combustion chamber;

a fuel transfer circuit at least partially formed in said injector body to deliver supply fuel to said injector orifice, said fuel transfer circuit including a first circuit and a second circuit in parallel with said first circuit;

a nozzle valve element positioned in said injector cavity adjacent said injector orifice, said nozzle valve element movable between an open position in which fuel may flow through said injector orifice into the combustion chamber and a closed position in which fuel flow through said injector orifice is blocked;

a rate shaping sleeve mounted on said nozzle valve element for movement between a first position blocking flow through said second circuit and a second position permitting flow through said second circuit, said rate shaping sleeve including a valve surface positioned in sealing contact with said nozzle valve element when said rate shaping sleeve is in said first position to block flow through said second circuit.

2. The injector of claim 1, wherein said rate shaping sleeve includes an inner distal end positioned axially along said injector body between said valve surface and said injector orifice.

3. The injector of claim 1, further including a bias spring positioned to bias said rate shaping sleeve away from said injector orifice into said first position.

4. The injector of claim 3, wherein said rate shaping sleeve is biased into said first position in abutment against a sleeve valve seat formed on said nozzle valve element.

5. The injector of claim 1, wherein said rate shaping sleeve is biased into said first position in abutment against a sleeve stop.

6. The injector of claim 5, further including a nozzle bias spring and a spring retainer positioned for abutment by said nozzle bias spring, said sleeve stop being formed integrally on said spring retainer.

7. The injector of claim 1, wherein said valve surface of said rate shaping sleeve is positioned in positive sealing abutment against said nozzle valve element to create said sealing contact when said rate shaping sleeve is in said first position.

8. The injector of claim 1, wherein said valve surface of said rate shaping sleeve is positioned for sliding movement against said rate shaping sleeve to create said sealing contact at a fluidically sealed sliding interface when said rate shaping sleeve is in said first position.

9. The injector of claim 1, wherein said first circuit of said fuel transfer circuit includes an orifice formed in, and extending through, said rate shaping sleeve.

10. The injector of claim 1, further including a damping chamber positioned to receive fuel to restrict movement of said rate shaping sleeve from said first position toward said second position.

11. The injector of claim 10, further including a damping orifice formed in said nozzle valve element to restrict fuel flow out of said damping chamber.

12. A closed nozzle fuel injector for injecting fuel at high pressure into the combustion chamber of an engine, comprising:

an injector body containing an injector cavity and an injector orifice communicating with one end of said injector cavity to discharge fuel into the combustion chamber;

a fuel transfer circuit at least partially formed in said injector body to deliver supply fuel to said injector orifice, said fuel transfer circuit including a first circuit and a second circuit in parallel with said first circuit;

a nozzle valve element positioned in said injector cavity adjacent said injector orifice, said nozzle valve element movable between an open position in which fuel may flow through said injector orifice into the combustion chamber and a closed position in which fuel flow through said injector orifice is blocked;

a rate shaping sleeve mounted on said nozzle valve element for movement between a first position blocking flow through said second circuit and a second position permitting flow through said second circuit; and a bias spring positioned to bias said rate shaping sleeve away from said injector orifice into said first position.

13. The injector of claim 12, wherein said rate shaping sleeve is biased into said first position in abutment against a sleeve valve seat formed on said nozzle valve element.

14. The injector of claim 12, wherein said rate shaping sleeve is biased into said first position in abutment against a sleeve stop.

15. The injector of claim 14, further including a nozzle bias spring and a spring retainer positioned for abutment by said nozzle bias spring, said sleeve stop being formed integrally on said spring retainer.

16. The injector of claim 12, wherein said valve surface of said rate shaping sleeve is positioned in positive sealing abutment against said nozzle valve element to create said sealing contact when said rate shaping sleeve is in said first position.

17. The injector of claim 12, wherein said valve surface of said rate shaping sleeve is positioned for sliding movement against said rate shaping sleeve to create said sealing contact at a fluidically sealed sliding interface when said rate shaping sleeve is in said first position.

18. The injector of claim 12, further including a damping chamber positioned to receive fuel to restrict movement of said rate shaping sleeve from said first position toward said second position, and a damping orifice formed in said nozzle valve element to restrict fuel flow out of said damping chamber.

19. A method of controlling an injection fuel flow rate from a closed nozzle fuel injector including an injector body containing an injector cavity and an injector orifice communicating with one end of said injector cavity to discharge fuel into the combustion chamber, a fuel transfer circuit including a first circuit and a second circuit in parallel with said first circuit, and a nozzle valve element movable between an open position in which fuel may flow through said injector orifice into the combustion chamber and a closed position in which fuel flow through said injector orifice is blocked, the method comprising:

moving a rate shaping sleeve mounted on the nozzle valve element between a first position in which said rate shaping sleeve is positioned in sealing contact with the nozzle valve element to block flow through the second circuit and a second position permitting flow through the second circuit.

20. The method of claim 19, further comprising damping the movement of said rate shaping sleeve from said first position toward said second position.

* * * * *